US005430234A

United States Patent [19]

Willis et al.

[11] Patent Number: 5,430,234

[45] Date of Patent: Jul. 4, 1995

[54] PROCESS FOR REMOVING PHOSPHORUS AND HEAVY METALS FROM PHOSPHORUS TRICHLORIDE STILL BOTTOMS RESIDUE

[75] Inventors: Terry W. Willis, St. Albans, W. Va.; Joseph H. Finley, Metuchen, N.J.; Monte L. Uhrig, Langhorne, Pa.; Harry M. Smith, St. Albans, W. Va.

[73] Assignee: FMC Corporation, Philadelphia, Pa.

[21] Appl. No.: 174,563

[22] Filed: Dec. 28, 1993

[51] Int. Cl.[6] ..... A62D 3/00

[52] U.S. Cl. ..... 588/246; 423/300; 423/481; 588/251; 588/256

[58] Field of Search ..... 423/300, 659, 481, 488; 588/244, 246, 251, 252, 256

[56] References Cited

U.S. PATENT DOCUMENTS

| | | | |
|---|---|---|---|
| 4,005,011 | 1/1977 | Sweeny | 210/18 |
| 4,113,504 | 9/1978 | Chen | 106/97 |
| 4,116,705 | 9/1978 | Chappell | 106/90 |
| 4,118,243 | 10/1978 | Sandesara | 106/109 |
| 4,142,912 | 3/1979 | Young | 106/98 |
| 4,149,968 | 4/1979 | Kupiec | 210/28 |
| 4,201,667 | 5/1980 | Liao | 210/50 |
| 4,359,005 | 11/1982 | Baston | 110/245 |
| 4,485,075 | 11/1984 | Maurel | 423/55 |
| 4,495,159 | 1/1985 | Maurel | 423/87 |
| 4,541,863 | 9/1985 | Riboud et al. | 588/251 |
| 4,671,882 | 6/1987 | Douglas et al. | 210/720 |
| 4,948,516 | 8/1990 | Fisher et al. | 210/751 |
| 5,252,306 | 10/1993 | Champion et al. | 423/300 |

FOREIGN PATENT DOCUMENTS

| | | | |
|---|---|---|---|
| 1111157 | 3/1979 | Canada . | |
| 3838671 | 5/1990 | Germany | 588/246 |
| 49-020952 | 2/1974 | Japan . | |
| 5120485 | 2/1976 | Japan . | |
| 54-160590 | 12/1979 | Japan . | |
| 57-068186 | 4/1982 | Japan . | |

*Primary Examiner*—Gary P. Straub

*Attorney, Agent, or Firm*—Patrick C. Baker; Robert L. Anderson; Richard E. Elden

[57] ABSTRACT

Unreacted phosphorus and heavy metals, such as arsenic and antimony, are removed in environmentally acceptable form from the non-aqueous still bottoms residue resulting from the production of $PCl_3$, by reacting the residue with an excess of calcium hydroxide in the form of an aqueous lime slurry and separating the reaction product into a precipitate and a filtrate. The reaction with lime slurry may be preceded by hydrolysis with water. The precipitate passes the Toxicity Characteristic Leaching Procedure (TCLP) test and the filtrate contains less than 5 ppm of the heavy metals, thus permitting disposal by landfill and sewering, respectively, under EPA regulations.

14 Claims, No Drawings

PROCESS FOR REMOVING PHOSPHORUS AND HEAVY METALS FROM PHOSPHORUS TRICHLORIDE STILL BOTTOMS RESIDUE

FIELD OF THE INVENTION

This invention relates to the treatment of residue from the manufacture of phosphorus trichloride to remove unreacted phosphorus and heavy metals in environmentally acceptable form.

BACKGROUND OF THE INVENTION

In one process for the production of phosphorus trichloride ($PCl_3$), chlorine gas is bubbled through molten phosphorus and product $PCl_3$ is distilled off as formed, leaving a non-aqueous bottoms residue. Over time, unreacted phosphorus, byproduct phosphorus compounds (such as phosphorus oxychloride, $POCl_3$), heavy metals (such as arsenic and antimony present with the molten phosphorus), heavy metal compounds, and residual $PCl_3$ concentrate in the still bottoms residue. This residue must be cleaned out periodically. The disposal of this residue poses a significant environmental hazard because of the high phosphorus and heavy metal content.

A variety of processes have been developed for treatment of heavy metal containing wastes to satisfy environmental concerns. In one such process (Japanese patent publication 51-20485—Kawano et al, 1976), an arsenic containing sludge from a sulfuric acid plant is neutralized with powdered lime and incinerated in the presence of excess lime. The product is a poorly soluble arsenate that can be discarded into the sea.

In another process (U.S. Pat. No. 4,948,516—Fisher et al), arsenic sulfide in the waste from phosphoric acid production is neutralized and dissolved with lime, then oxidized to the water insoluble pentavalent state, and finally solidified by treatment with cement or other binder. The solid mass is said to entrap the arsenic and other heavy metal compounds whereby leaching out upon exposure to ambient moisture is essentially prevented. Leachability was determined by the Toxicity Characteristic Leaching Procedure (TCLP) test.

Other fixing or binding approaches include the use of Portland cement (U.S. Pat. Nos. 4,113,504—Chen and 4,142,912—Young) and vermiculite and cement after neutralization with lime (U.S. Pat. No. 4,113,504—Chen).

Soluble arsenic salt containing waste from the manufacture of herbicides has been converted to insoluble form suitable for landfill disposal by reaction in aqueous medium with sulfuric acid and calcium hydroxide in the presence of ferrous ion sufficient to ensure curing to solid form upon exposure to oxygen gas (U.S. Pat. No. 4,118,243—Sandesara).

Arsenic-containing aqueous media, such as waste water or clean-out wash water from $PCl_3$ production, have been treated with lime in the presence of phosphorus in order to precipitate the arsenic and phosphorus and to allow safe reuse or disposal of the water. Oxidation, as by reaction with chlorine, may be practiced, preferably before the lime treatment, to convert water soluble, trivalent arsenic and phosphorus salts to water-insoluble, pentavalent form. (U.S. Pat. No. 4,201,667—Liao).

In none of these processes has the non-aqueous still bottoms residue from $PCl_3$ production been treated. This residue is characterized by a high concentration of heavy metals, for example of the order of 1–7% by weight, in the form of water soluble, lower oxidation state, compounds. It is desirable to economically convert this residue to a form suitable for direct disposal in an environmentally acceptable manner.

SUMMARY OF THE INVENTION

In accordance with one aspect of the present invention, the nonaqueous still bottoms residue from production of $PCl_3$ is reacted with a stoichiometric excess of calcium hydroxide in the form of an aqueous lime slurry, followed by separation of the precipitate which forms.

By careful selection of the lime slurry solids and the weight ratio of lime slurry to the still bottoms residue, the precipitate will pass the U.S. Environmental Protection Agency's (EPA) Toxicity Characteristic Leaching Procedure (TCLP) test as described in the Federal Register, Vol. 151, No. 114, Jun. 13, 1986, page 21685. The leachability limit of this test for landfilling of wastes containing arsenic and/or antimony is 5 ppm (5 mg/L). Moreover, the filtrate resulting from the treatment will contain no more than 5 ppm of arsenic.

In another aspect of the invention, the still bottoms residue is initially hydrolyzed with water and then reacted with the aqueous lime slurry.

The treatment thus permits, under present EPA regulations, direct disposal of precipitate and filtrate without further treatment. The lime slurry treatment simultaneously neutralizes any acidic products or byproducts in the residue and hydrolyzes any $PCl_3$ or $POCl_3$ remaining in the residue.

DETAILED DESCRIPTION

The feed material treated in accordance with the invention is the semi-solid, substantially non-aqueous residue remaining after distillation of $PCl_3$ from the product stream in the manufacture of $PCl_3$. This residue, commonly called a "still bottoms residue", "still bottoms" or "bottoms", must be removed periodically from the distillation column for disposal.

Over the course of repeat distillation the bottoms become more concentrated in byproducts of the $PCl_3$ process and will include trace or minor amounts of $PCl_3$ not removed in the distillation. The dominant components are unreacted heavy metals and phosphorus carried through the $PCl_3$ process, and heavy metal and phosphorus compounds formed during the process.

The heavy metals include arsenic and antimony. Disposal of these metals and compounds formed therefrom is subject to EPA regulations particularly with respect to the leaching of these metals and metal compounds into the environment if disposed of in a landfill.

Typically, the residue consists of a non-aqueous liquid phase (about 90–95% of the total) and a solid or sludge phase (about 5–10% of the total). The liquid phase may contain some suspended solids but also contains substantial quantities of lower valence heavy metal compounds such as $AsCl_3$ and $SbCl_3$. It may also contain substantial amounts of $PCl_3$ not removed in the distillation, and $POCl_3$. The solid phase predominantly contains elemental heavy metals, such as arsenic and antimony, unreacted phosphorus, and carbon or carbon compounds. It may also contain minor or trace amounts of pentavalent heavy metal compounds, such as $AsCl_5$ and $SbCl_5$.

It will be understood, however, that the composition of the bottoms residue can vary widely, depending on the heavy metal content in the phosphorus feedstock to the $PCl_3$ process, time between cleanout of the residue, and the extent to which the residue is further concentrated by distillation, filtration, decantation or other separation process.

The lime content in the aqueous slurry used for treatment of the still bottoms residue can vary over a wide range, depending on the mode of contact with the residue and its composition. A typical solids content is 5–25%. A preferred solids content, for ease of handling and transport and for yield of manageable amounts of treatment product for waste disposal, is about 10–20%, more preferably about 15%. A stoichiometric excess of lime, as $Ca(OH)_2$, is required for complete reaction with the residue. The stoichiometry, of course, will vary with the reactive matter in the residue. For example, based on the reaction (1):

$$2PCl_3+5Ca(OH)_2=2CaHPO_3+3CaCl_2+4H_2O \quad (1)$$

the stoichiometric ratio of lime as a 15% aqueous slurry to $PCl_3$ would be 9:1 lb/lb. In practice, however, on a residue also containing other reactive ingredients as described above, best results were obtained at a ratio of at least 14:1 lb/lb on the same basis.

Another reaction that most likely takes place is (2):

$$2M(Cl)_3+3Ca(OH)_2=2M(OH)_3+3CaCl_2 \quad (2)$$

where M is a heavy metal such as arsenic and/or antimony in the trivalent state. Again, a stoichiometric excess of lime, as $Ca(OH)_2$, is required for good reaction.

Generally, at least 50% excess over stoichiometry is desirable, preferably in the range of 50–200% excess, depending on the composition of the residue being treated. In practice, on the basis of a 15% solids lime slurry, a weight ratio of at least 10 parts of lime slurry per part of residue has been found effective. A preferred range is 10–20 parts lime, slurry,per part of residue, more preferably 12–15 parts slurry per part of residue, on the basis of a 15% solids lime slurry.

The non-aqueous still bottoms residue and the aqueous lime slurry may be combined in any convenient manner. However, since the reaction is exothermic, it is preferred to slowly or incrementally add the residue to the excess lime slurry. With suitable reactor design, to protect against a runaway reaction, the lime slurry can be added to the residue, again slowly or incrementally.

The reaction temperature is desirably maintained at a temperature not over 80° C. to minimize formation of phosphine, a toxic and flammable gas. A preferred temperature is not over 60° C., more preferably about room temperature (20°–25° C.). Conventional cooling means can be used for temperature control. The reaction zone and vessel normally is blanketed with nitrogen or other inert gas to prevent formation of explosive phosphine/air mixtures.

In a modification of the treatment described above, the chlorides in the still bottoms residue ($PCl_3$, $POCl_3$, $AsCl_3$, $SbCl_3$ and other chlorides) are hydrolyzed by addition of water prior to reaction with aqueous lime slurry. This modification may be necessary if the residue cannot be transferred, due to environmental restrictions, prior to being rendered non-toxic and/or stabilized against excessive leachability. Hydrolysis prior to combination with lime slurry will give better control over the total treatment because the heat evolved in the hydrolysis can be dissipated prior to the exotherm incursion from reaction with the lime slurry. For effective temperature control during the water addition and hydrolysis, the reaction vessel should be externally cooled, to maintain reaction temperature of not over 80° C., preferably not over 60° C., and the water preferably is added slowly or incrementally.

An amount of water substantially equal to the weight of residue will be effective for the hydrolysis but other amounts can be used, for example, from a stoichiometric amount (about 0.4 part water per part of $PCl_3$) to ten times the theoretical amount, depending on the composition of the residue.

During the hydrolysis, HCl gas will be liberated. The gas is conveniently trapped and neutralized overhead in a lime slurry. This lime slurry can then be combined with other lime slurry and fed to the residue in the pot for completion of the treatment.

Although with suitable pressure controls the entire amount of aqueous lime slurry calculated to provide the stoichiometric excess for complete reaction (neutralization and dissolution) can be combined with the hydrolyzed residue, it is preferred to slowly or incrementally add the lime slurry to the residue while dissipating the resulting exotherm by external cooling, and neutralizing in an overhead lime slurry trap any HCl gas liberated, as described above. In this manner, the reaction is more effectively controlled.

The lime treatment precipitates a solid which may be separated from the liquid phase by filtration, decantation or other conventional separation technique. The separated wet cake contains 1% or more of arsenic but under the conditions of the TCLP test, no more than 5 ppm of arsenic will leach from the sample. The material therefore satisfies EPA requirements for disposal in a landfill. The material is said to be "stabilized" because it resists leaching of arsenic into the soil. Similarly, the filtrate analyzes less than 5 ppm of arsenic and therefore, under present EPA regulations, can be sewered.

In the course of the reaction it is believed, but not precisely known, that the heavy metals, heavy metal compounds, phosphorus, and phosphorus compounds are hydrolyzed, and any other acidic products or byproducts (such as HCl and/or $PH_3$) neutralized. Surprisingly, the treatment is effective without an oxidation step as practiced in the prior art, for example by chlorination to effect conversion of the trivalent metals and metal compounds to the more insoluble pentavalent state.

Accordingly, not only may an oxidation step, as in the prior art, be avoided by the present invention but also the reaction products may be disposed of without further treatment, for example, by binding with cement or other materials. The treatment therefore is highly economical and efficient.

The following examples are intended to further illustrate but not to limit the scope of the invention. In the examples and throughout this specification and claims, all parts and percentages are by weight and all temperatures are °C., unless otherwise stated. Also, throughout this specification and claims, where not otherwise indicated, the terms "heavy metals" and "phosphorus" mean and include elemental metals and phosphorus as well ionic state materials and compounds.

EXAMPLE 1

A non-aqueous bottoms cleanout residue from distillation of the product from a $PCl_3$ manufacturing process was separated into liquid and solid portions and analyzed. The dark liquid portions, comprising about 90–95% of the total cleanout residue and containing some suspended solids, had the composition set forth in Table I below. The solid portions, comprising about 5–10% of the total cleanout residue, had the composition set forth in Table II below

TABLE I

| LIQUID PORTION OF $PCl_3$ RESIDUE | | | |
|---|---|---|---|
| Element | % Found[1] | % as $PCl_3$ | % as $AsCl_3$ |
| Phosphorus | 21.5 | 94.9 | — |
| Chlorine | 72.9 | 94.1 | — |
| Arsenic | 3.5 | — | 8.5 |
| Antimony | 370 ppm | — | — |
| | 97.9 total | | |

[1]A small quantity of insolubles, formed during the atomic absorption (AA) sample preparation for arsenic and antimony analysis, consisted mostly of bromine.

TABLE II

| SETTLED SLUDGE FROM $PCl_3$ CLEANOUT RESIDUE | |
|---|---|
| Element | % Found[1] |
| Phosphorus | 10.8 |
| Arsenic | 0.41 |
| Antimony | 10.0 |
| Total Organic Carbon | 20–21 |

[1]Insolubles, formed during AA sample preparation, consisted mainly of bromine and antimony.

To a 5 liter, 3-necked round bottom flash equipped with an air-driven overhead stirrer, nitrogen inlet tube, thermometer and reflux condenser was added 3380 grams of a 15% aqueous lime slurry. The flask and contents were cooled in an ice bath. Two hundred grams of the cleanout residue were added slowly over a one hour period while sweeping the reactor with a slow stream of nitrogen and maintaining the temperature between 22°–27° C. The phosphine level in the off-gas was determined to be less than 0.3 ppm by measurements with a Sensidyne analyzer tube.

A representative portion (176.5 g) of the product slurry was removed and filtered, yielding a wet cake weighing 47.4 g and 128.7 g of filtrate. The filtrate was found to contain less than one ppm each of arsenic and antimony, indicating that the filtrate can be sewered under existing regulations.

The wet filter cake containing 1.0% arsenic and 93 ppm of antimony was subjected to a modified TCLP test.

In the TCLP test a filter cake is treated with 20 times its weight of buffered (pH 2.93) acetic acid and the mixture agitated at 30 rpm for 18 hours. The sample is then pressure-filtered (50 psi) and the arsenic content determined. The test was modified by fastening the bottle containing the sample residue to the slow shaft of an electric motor by means of a chain clamp, and then rotating the bottle end-over-end at about 30 rpm. A further modification was pressure-filtration through a 0.6 micron BD Millipore filter (as compared with a binder-free glass filter in the unaltered TCLP protocol).

The modified TCLP test yielded leachability values of 1.0 ppm for arsenic and less than 1.0 ppm for antimony. These values are much lower than the 5 ppm maximum leachability limit and indicate that the wet cake can be landfilled.

The remaining portion of the product slurry was sent for independent TCLP testing.

The results confirmed the test results of the modified TCLP test, demonstrating that the heavy metals in the filter cake were effectively stabilized against leaching.

EXAMPLE 2

A non-aqueous bottoms cleanout residue from distillation of the product from a $PCl_3$ manufacturing process contained 9% solids and the following liquid composition (by gas chromatography): 85% $PCl_3$, 3.0% $POCl_3$, 9.6% $AsCl_3$ and 1.5% $SbCl_3$. The residue was concentrated to 16% solids by distilling off $PCl_3$. To 200 g of the concentrated residue under nitrogen sweep and external cooling was slowly added 200 g of water. HCl gas, from hydrolysis of $PCl_3$, $POCl_3$ and heavy metal chlorides in the residue, was liberated to an overhead scrubber containing a lime slurry (15% solids) and neutralized.

Various levels of 15% aqueous lime slurry, also containing lime slurry from the overhead scrubber, were incrementally added to the solids concentrate to determine the minimum effective ratio of lime slurry/residue. The reaction was otherwise conducted essentially as described in Example 1. The criterion for acceptability was the ability of the wet cake formed by this treatment to pass the TCLP test.

The test results below (Table III) show that a 9/1 weight ratio is insufficient, but that both arsenic and antimony pass the TCLP test at 12/1 and higher ratios. These ratios may differ, of course, depending on the composition of the bottoms residue. As shown in Table III, in all cases the filtrate contained less than 5 ppm of the heavy metal, thus permitting disposal by sewer.

TABLE III

| Ratio: 15% lime slurry/residue | Arsenic, ppm | Antimony, ppm |
|---|---|---|
| | Wet Cake: TCLP Leachability | |
| 9/1 | 460 | 5.5 |
| 12/1 | 0.93 | 0.6 |
| 15/1 | 0.94 | 0.6 |
| | Filtrate Analysis, ppm | |
| 9/1 | 1.2 | 3.9 |
| 12/1 | 1.2 | 2.8 |
| 15/1 | 1.1 | 1.9 |

We claim:

1. A process for treating non-aqueous still bottoms residue from the production of $PCl_3$ to remove unreacted phosphorus and heavy metals in environmentally acceptable form, comprising reacting the residue with a stoichiometric excess of calcium hydroxide in the form of an aqueous lime slurry and separating the reaction product into a precipitate and a filtrate, the lime slurry solids and weight ratio of lime slurry to the residue being selected such that the precipitate passes the Toxicity Characteristic Leaching Procedure (TCLP) test, the filtrate contains less than 5 ppm of the heavy metals, and any acidic materials present or formed in the reaction are neutralized.

2. The process of claim 1 wherein the metals are selected from arsenic, antimony and mixtures thereof.

3. The process of claim 1 wherein the still bottoms residue is reacted with lime slurry at a weight ratio of at least 10 parts of lime slurry per part of still bottoms residue, based on a lime slurry containing 15% solids.

4. The process of claim 1 wherein the still bottoms residue is reacted with lime slurry at a weight ratio of at least 12 parts of lime slurry per part of still bottoms residue, based on a lime slurry containing 15% solids.

5. The process of claim 1 wherein the still bottoms residue is reacted with lime slurry at a weight ratio in the range of 10–20 parts of lime slurry per part of still bottoms residue, based on a lime slurry containing 15% solids.

6. The process of claim 1 wherein the still bottoms residue is added slowly or incrementally to the lime slurry, a temperature of not over 80° C. is maintained during the reaction, and the reaction is conducted in an inert atmosphere.

7. The process of claim 1 wherein the lime slurry is added slowly or incrementally to the still bottoms residue, a temperature of not over 80° C. is maintained during the reaction, and the reaction is conducted in an inert atmosphere.

8. The process of claim 1 wherein the still bottoms residue is reacted with lime slurry at a weight ratio of at least 10 parts of lime slurry per part of still bottoms residue, based on a lime slurry containing 15% solids, the still bottoms residue is added slowly or incrementally to the lime slurry, a temperature of not over 80° C. is maintained during the reaction, and the reaction is conducted in an inert atmosphere.

9. The process of claim 8 wherein the temperature is not over 60° C.

10. The process of claim 8 wherein the temperature is not over 60° C. and the weight ratio is in the range of 10–20 parts of lime slurry per part of still bottoms residue based on a lime slurry containing 15% solids.

11. The process of claim 1 wherein, prior to reaction with lime slurry, an at least stoichiometric amount of water to hydrolyze chlorides is added to the residue.

12. The process of claim 11 wherein the lime slurry is added incrementally to the residue and a temperature of not over 80° C. is maintained during the hydrolysis and reaction.

13. The process of claim 1 wherein HCl gas liberated during the reaction is neutralized overhead.

14. The process of claim 12 wherein HCl gas liberated during the hydrolysis and reaction is neutralized overhead.

* * * * *